US005895284A

United States Patent [19]

Kocher et al.

[11] Patent Number: 5,895,284

[45] Date of Patent: Apr. 20, 1999

[54] LATCHING SYSTEM

[75] Inventors: Timothy Lee Kocher, Camp Hill; Navin Kanjibhai Patel, Hummelstown, both of Pa.; Michael Albert Viselli, Vancouver, Wash.

[73] Assignee: The Whitaker Corporation, Wilmington, Del.

[21] Appl. No.: 08/899,458

[22] Filed: Jul. 23, 1997

Related U.S. Application Data

[60] Provisional application No. 60/025,476, Jul. 31, 1996.

[51] Int. Cl.[6] ..... H01R 13/627

[52] U.S. Cl. ..... 439/357

[58] Field of Search ..... 439/350, 353–357, 439/358, 79

[56] References Cited

U.S. PATENT DOCUMENTS

| | | | |
|---|---|---|---|
| 4,026,624 | 5/1977 | Boag . | |
| 4,108,522 | 8/1978 | Favale . | |
| 4,273,403 | 6/1981 | Cairns . | |
| 5,110,302 | 5/1992 | Kobler | 439/357 |
| 5,137,466 | 8/1992 | Endo et al. | 439/357 |
| 5,344,335 | 9/1994 | Scholz et al. | 439/357 |
| 5,484,301 | 1/1996 | Koumatsu et al. | 439/271 |
| 5,501,606 | 3/1996 | Oda et al. | 439/357 X |

FOREIGN PATENT DOCUMENTS

| | | | |
|---|---|---|---|
| 0510229 | 10/1992 | European Pat. Off. | H01R 13/627 |
| 2669897 | 6/1992 | France | B65D 55/14 |
| 2909616 | 9/1980 | Germany | H01R 13/54 |

OTHER PUBLICATIONS

PCT International Search Report; PCT16579; PCT/US97/13398; International Filing Date: Jul. 30, 1997.

*Primary Examiner*—Khiem Nguyen
*Attorney, Agent, or Firm*—Katherine A. Nelson

[57] ABSTRACT

A latching system for latching first and second connectors (120,20) together along a mating axis includes a pair of latch arms (126) spaced a selected distance apart along a common side (124) of a first housing (122) and extending to free ends (127) proximate the mating face (133) thereof, and a pair of embossments (50) spaced along a common side (24) of a second housing (22) includes beams (52) extending outwardly therefrom a second selected distance beyond a mating face (46) to free ends (53). Upon mating the connectors (120, 20), the free ends (53) of the embossments (50) stabilize axial alignment and orientation of the connectors (120, 20) relative to each other during final stages of mating. The embossments (50) pass freely beside the latch arms (126) during initial stages of mating until the connectors (120, 20) are axially aligned whereupon the latch arms (126) latch during final stages of mating.

7 Claims, 6 Drawing Sheets

LATCHING SYSTEM

This application claims the benefit of U.S. Provisional application(s) Ser. No(s). 60/025,476, Filed Jul. 31, 1996.

FIELD OF THE INVENTION

The present invention relates to electrical connectors and more particularly to latching systems for securing matable electrical connectors together.

BACKGROUND OF THE INVENTION

Various latching systems are known for latching together housings of opposing electrical connectors being mated to engage mating pairs of contact terminals secured therein. When one of the connectors is a right angle connector mounted to a circuit board, the latching system needs to be provided at either the two ends of the connector or along a common side parallel to a circuit board. To minimize real estate on the circuit boards it is more desirable to have a latching system that is on a common side of the housings. U.S. Pat. No. 5,344,335 discloses one such latching system in which one of the connectors includes a latch arm having a spaced apart pair of latches, each being received in latching slots on the other connector near the lateral ends of the connectors. This type of latching system, however, requires additional height beyond the housing envelope of the connector, which may interfere with stacking the connectors close together. In those instances where it is desirable to have an array of connectors in a closely stacked arrangement, such as a card cage, for example, it is desirable to have a latching system that essentially functions within the envelope of the housing walls and one that furthermore provides a clear indication that the housings are in a full mated condition. It is also desirable to provide a latching system that can minimize that possibility of incomplete latching and incomplete mating.

SUMMARY OF THE INVENTION

The present invention is directed to a latching system for securely latching first and second connectors together along a mating axis. The first and second connectors include respective first and second housings. A pair of latch arms are spaced a selected distance apart along a common side of the first housing and extend to free ends proximate the mating face thereof. The latch arms are adapted to cooperate with a complimentary latching surface on a corresponding common side surface of the second housing. The respective free ends of the latch arms include latching projections extending toward ends of the housing and defining rearwardly facing latching surfaces. The common side surface of the second housing includes a pair of embossments extending laterally outwardly therefrom defining complementary latch surfaces. The embossments are positioned in alignment with the free ends of the latch arms and are initially abutted by camming surfaces of the free ends during initial stages of latching. The latch arms are adapted to be deflected toward the ends of the housing upon the camming surfaces bearing against the embossments. As the latching process proceeds, the latching projections pass by the embossments and become latched therebehind. The latch arms are deflectable in a direction parallel to the common side of the first housing minimizing the clearance area adjacent the housing needed for deflection of the latch arms.

In the embodiment shown the embossments are essentially L-shaped and provide beams extending outwardly from the housing a second selected distance beyond a mating face to free ends and a wider block-like base that requires the latch arms to be deflected. Upon mating of the connectors the free ends of the beams extending along and outwardly of surface portions of the common side of the second housing stabilize the axial alignment and orientation of the connectors relative to each other during the final stages of mating. The beams freely pass beside the latch arms during initial stages of mating until the connectors are axially aligned whereupon the latch arms latch during final stages of mating. The block-like portion of the L-shaped embossment generates substantial resistance to latching during the mating thus requiring the application of more force to deflect the arms outwardly. The momentum generated by the increased force accelerates the mating of the connectors, which move rapidly together until the latch arms latch behind the end of the corresponding embossment. When the latching sections of the latch arms pass the forward most radii of the embossments the resistance to latching suddenly ceases. The latching sections continue to move along the flat surfaces of the embossments and upon reaching the ends thereof immediately latch behind the embossments to secure the connectors together. The force required to overcome the resistance between the latch arms and the rearwardly facing surface of the embossments when unmating the connectors results in accelerated unmating thus minimizing any damage to terminals if the connectors are unmated when the system is energized.

It is an object of the invention to provide a latching system that stabilizes the axial alignment and orientation of the connectors prior to mating of the terminals therein.

It is a further object of the invention to provide a latching system that assures that both mating and unmating of the terminals of the connectors will occur rapidly.

An embodiment of the invention will now be described by way of example with reference to the accompanying drawings.

BRIEF DESCRIPTION OF THE DRAWINGS

FIG. 2 is a flat plan view illustrating the initial alignment of the connectors with guide posts at the end of the connectors providing the alignment.

FIG. 3 is a view similar to that of FIG. 2 illustrating partial mating wherein the embossments have entered the corresponding openings beside the associated latch arm.

FIG. 4 is a view similar to that of FIG. 2 illustrating a further mating of the connectors wherein the end of latch arms engage the wider portion of embossments.

FIG. 5 is a view similar to that of FIG. 2 wherein the connectors are almost mated and the latches are deflected around the embossments.

FIG. 6 is a view similar to that of FIG. 2 showing the connectors after they have been fully mated and the latch arms engaged around the latching embossments.

DETAILED DESCRIPTION OF AN EMBODIMENT OF THE INVENTION

For purposes of illustrating the invention, the latching system is being shown in use with a terminal block connector that is matable to a receptacle connector, shown as a pin header, intended to be mounted in a card cage. It is to be understood that the latching system may be used with other connectors as well.

Figure 1:
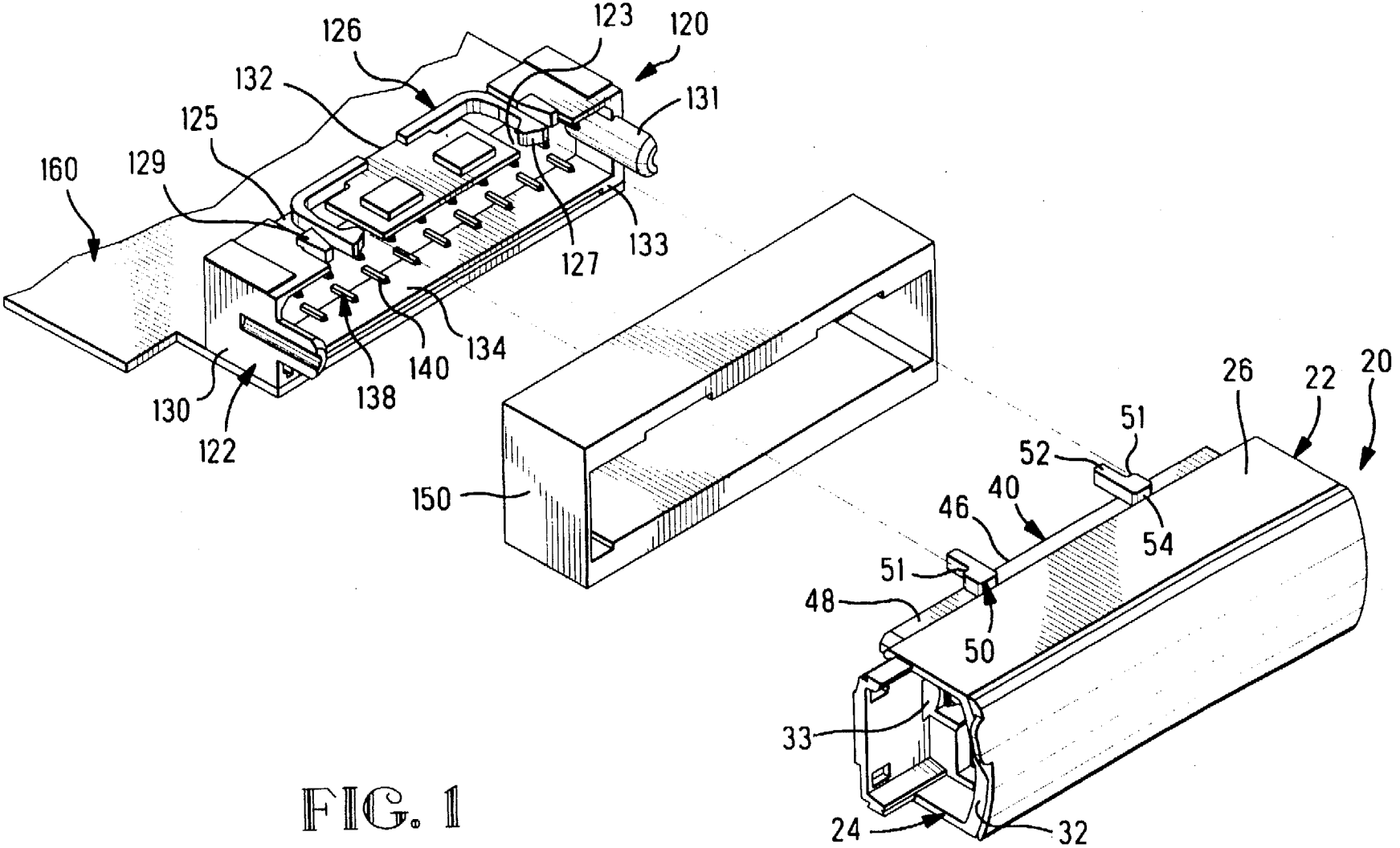
FIG. 1 is a perspective view of plug and receptacle connectors prior to mating with the receptacle exploded from the circuit board and the frame of a panel.

As shown in FIGS. 1 through 6, the receptacle connector 120 includes a housing 122 having side walls 124 and end walls 130, which together with the base 132 define a plug receiving cavity 134 that is open at the mating face 133. A plurality of terminals 138 are disposed in the cavity 134, each terminal 138 having a first connecting portion 140 disposed for mating with the complimentary terminals 90 of mating connector 20. As seen in FIG. 1, receptacle connector 120 is a right angle connector having second connecting portions 142 adapted to be electrically connected to terminal pads of a circuit board 160. Side wall 124, which is opposite board mounting face 135, includes a pair of latch arms 126 spaced a selected distance apart along the common wall and extend to free ends 127 proximate the mating face 133. As shown herein the latch arms 126 are disposed within recesses 125 of the side wall 124 such that they are substantially contained within the thickness of the side wall 124, thus enabling connector 120 to be disposed in a shell 150 for use in a card cage or the like, as illustrated in FIG. 1. Side wall 124 further includes an anti-overstress embossment 129 proximate the leading end of the latch arm 126. Housing 122 also includes a pair of guide posts 131 extending outwardly from the mating face 133 proximate the end walls 130 for establishing initial alignment.

Referring now to FIGS. 1 through 6, plug connector 20 includes a housing 22 having a plug portion 40 slidably received in a shell portion 24. The plug portion 40 includes sidewalls 48. A pair of latching embossments 50 including beams 52 extending along a common side wall 48 and outwardly from the housing 22 a second selected distance beyond the mating face 46 to free ends 53. The embossments 50 are essentially L-shaped with beams 52 being narrower than the rearward block-like section of the embossment 50. The block-like section includes a latch engaging surface 51 proximate the mating face 46 and a rearward facing latch surface 54.

Figure 2:
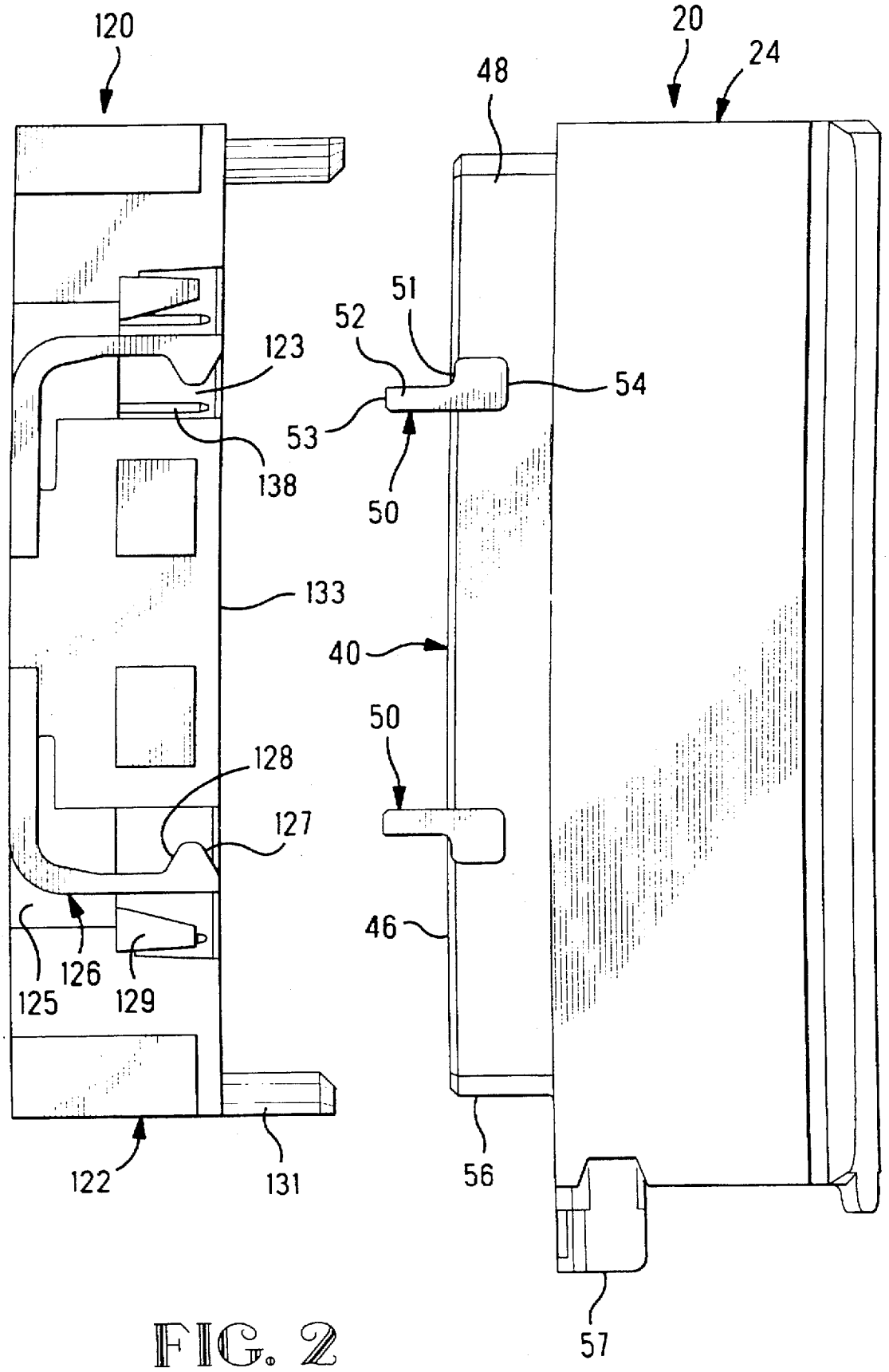
FIGS. 2 through 6 illustrate the sequence of mating of the connectors and the latching system.
Figure 3:
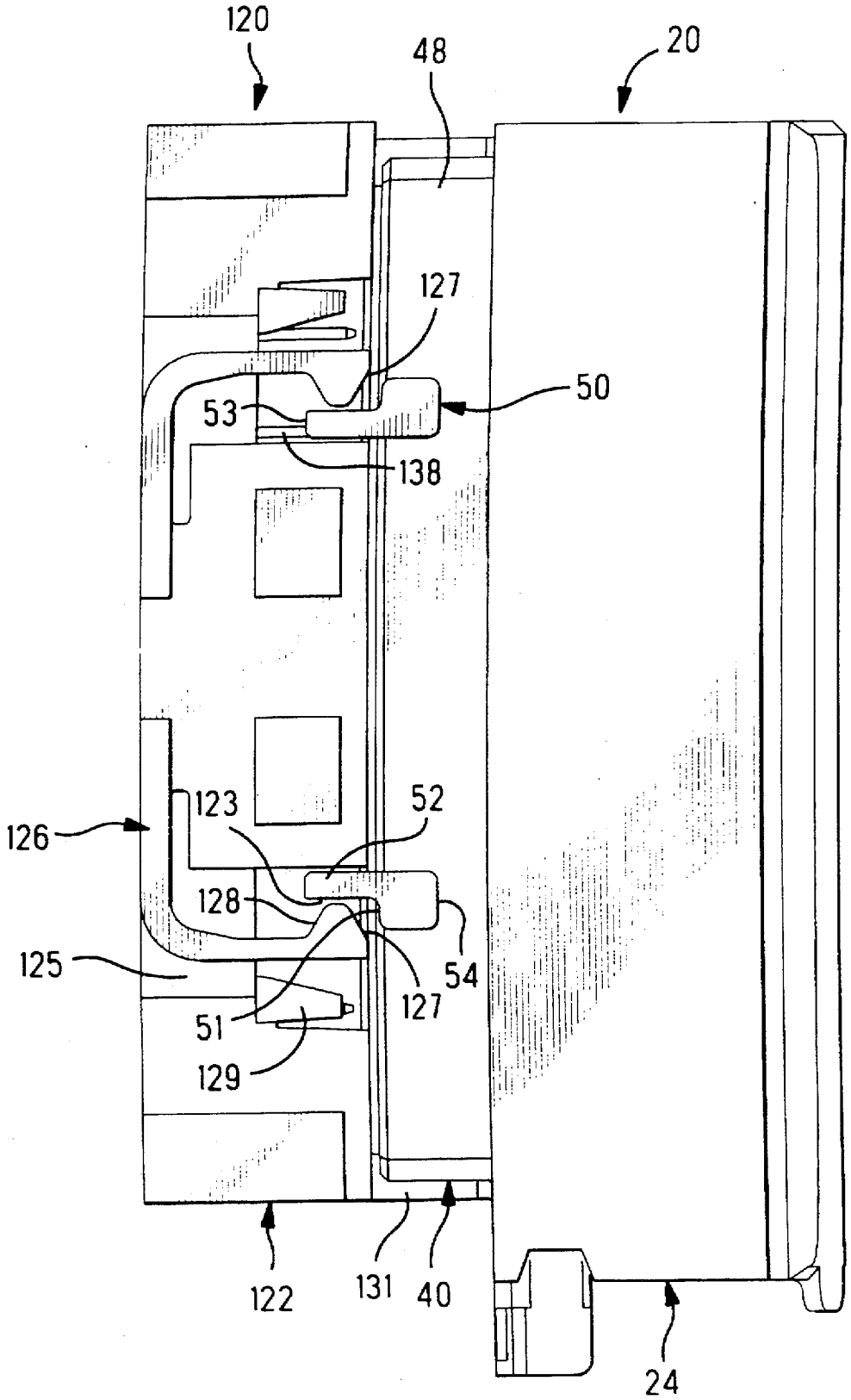
Figure 4:
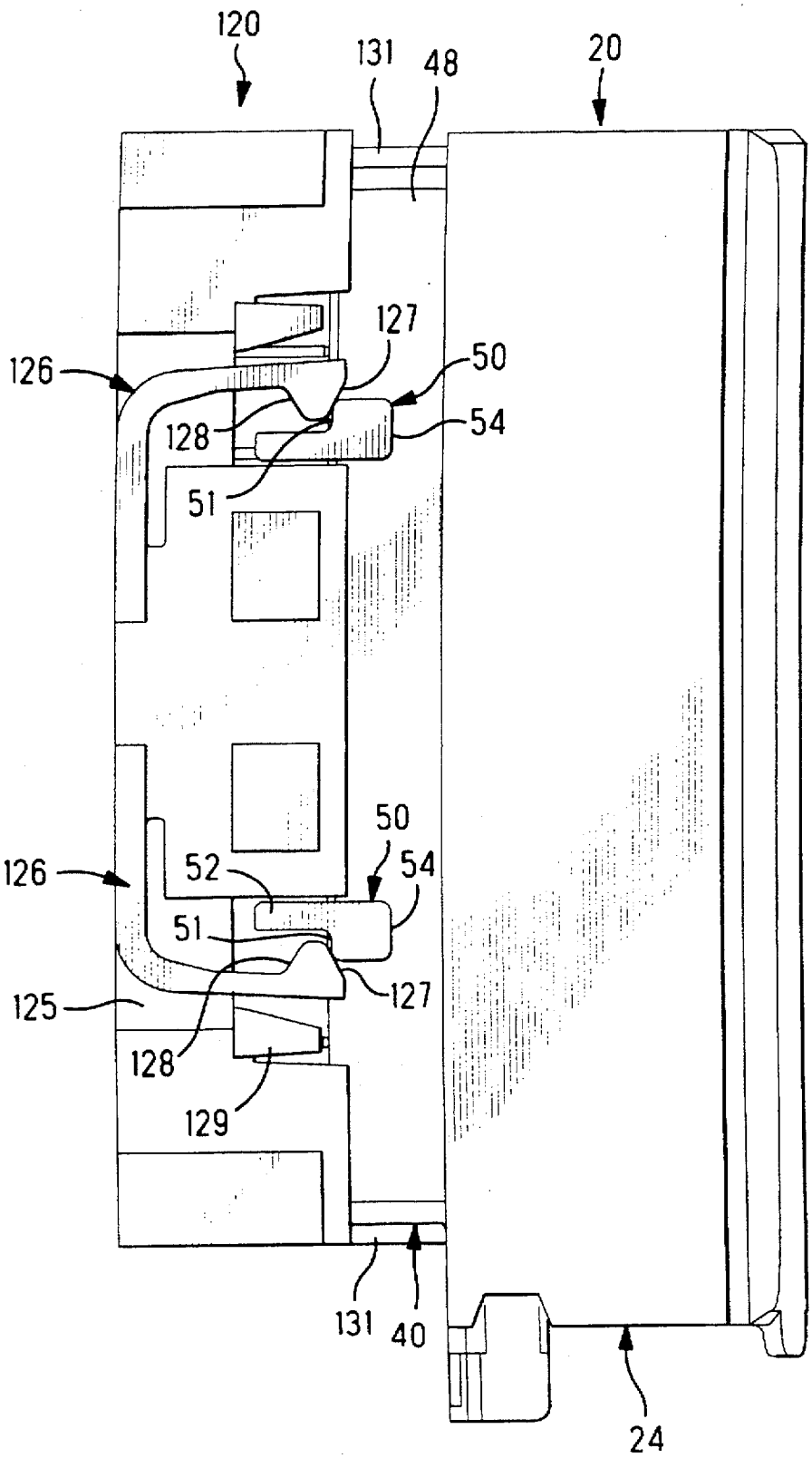
Figure 5:
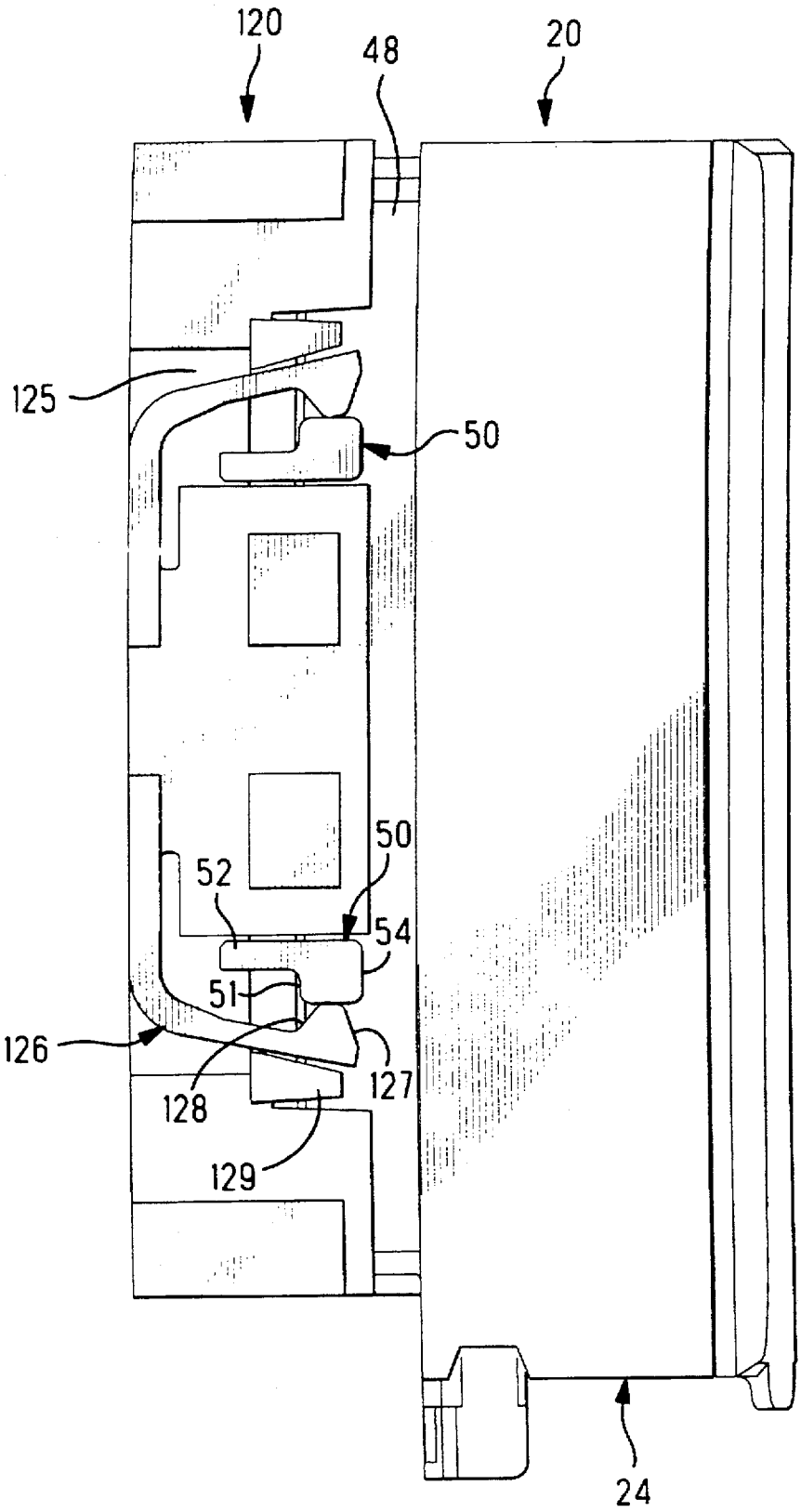
Figure 6:
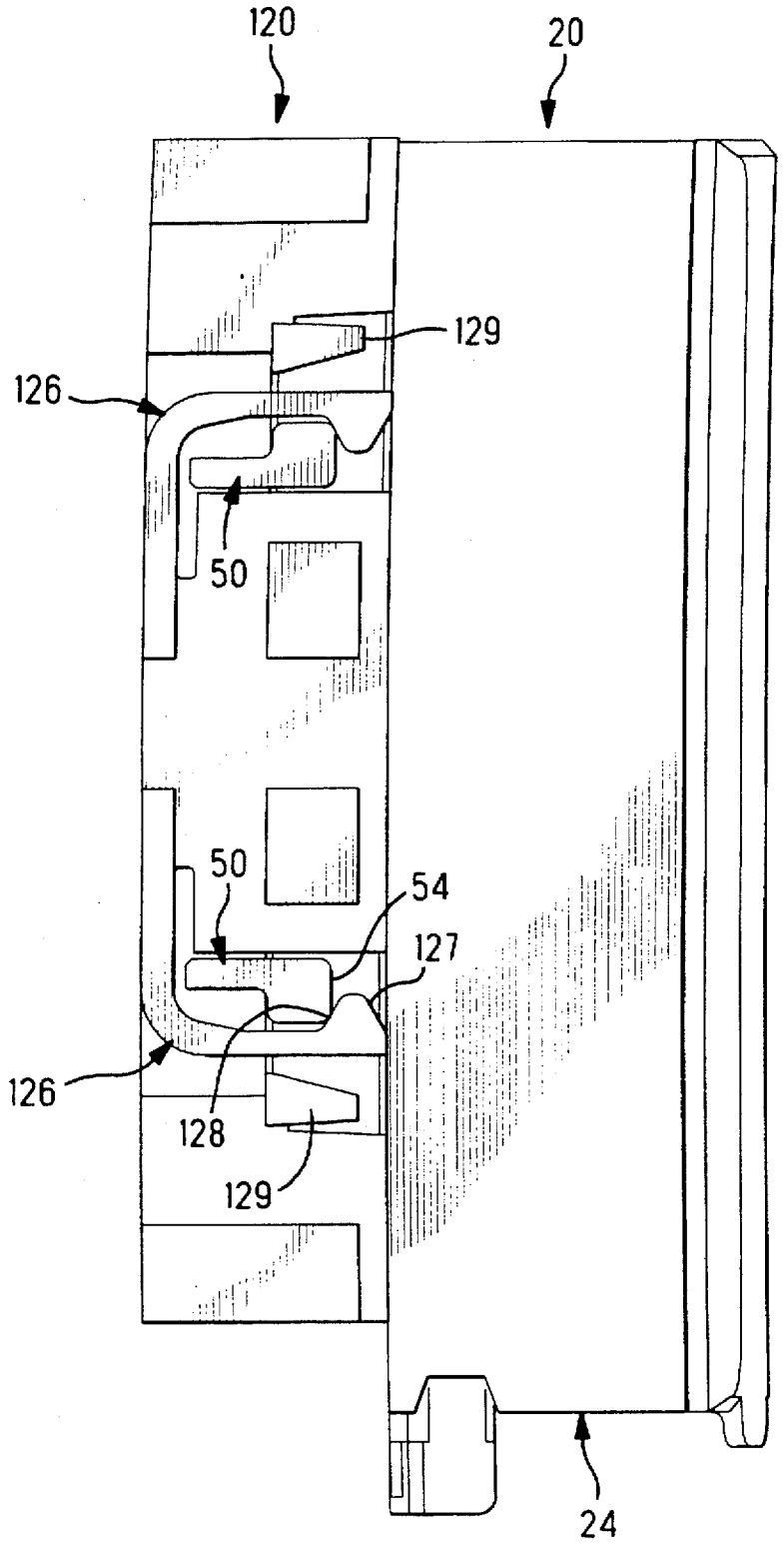

FIG. 2 illustrates first and second connectors 120, 20 in alignment for mating with the respective guide posts 131 aligned with corresponding apertures 33 in plug 20 and the leading ends 53 of beams 52 proximate the mating face 133 of receptacle connector 120. In FIG. 3 the connectors 120, 20 are moved close together such that the beams 52 enter the spaces 123 between the forward leading ends 127 of the latch arms 126 and pass freely beside the latch arms 126 until the slanted surface of leading end 127 of the latch arms 126 engage the latch engaging surfaces 51 of embossments 50 as shown in FIG. 4. At this stage of mating resistance to movement is increased by the engagement of surfaces 127 and 51 such that increased force is needed to mate the plug 20 with the receptacle 120. The momentum generated by the force accelerates the speed at which the connectors are mated. As the force is increased the connectors are brought closer together and latch arms 126 are deflected outwardly by embossments 50 until the latching sections pass the forward most radii of the embossments and the resistance to latching suddenly lessens. The latching sections move along the flat surfaces of the embossments until the latch arms reach the latch surface 54 whereupon the latch arms 126 resile back to there original position with latch surface 128 engaging the latch surface 54 of embossments 50 to hold the two connectors 20, 120 securely together. As seen in FIGS. 2 through 6, side walls 124 also include raised embossments 129 which act as anti overstress features to prevent the latch arms 126 from being deflected outwardly past their breaking point. FIG. 6 shows the two connectors 20, 122 in the fully mated condition.

The latching system of the present invention offers a number of advantages. The shape of the embossment 50 and the latch arms 126 are dimensioned such that it requires an increase in force to mate or to unmate the connectors. This extra force is sufficient to deflect the arms 126 such that once the deflection has begun the completion of the mating or unmating is carried out rapidly to help ensure that the connectors 20, 120 are fully mated or unmated. The speed at which the mating or unmating occurs minimizes damage to the terminals in the connectors when or if the connectors are mated or unmated while the current is flowing or "hot".

The extended length of beams 52 on the embossments 50 assure that the plug connector 20 is guided into correct and stabilized axial alignment and orientation with receptacle connector 120 prior to the mating of the receptacle terminals with the pin terminals of the header. While the guide posts 131 begin the alignment, the beams 52 ensure that the two connectors 20, 120 are not mated at an angle. The surface 51 of embossments 50 are a sufficient distance from the mating face 46 of plug 20 to assure that the terminals 138, 90 do not touch until the plug connector 20 begins to accelerate under the increase in force to overcome the resistance between the latch engaging surface 51 of embossments 50 and the leading ends 127 of latch arms 126. During unmating the resistance of the embossment 50 and latch surface 54 thereof against the latch surface 128 of the latch arm 126 also require sufficient force to deflect the latch arms 126 outwardly thus ensuring that the connectors 20, 120 are unmated quickly again to minimize any damage to the terminals when unmated under "hot" conditions.

The latch arm of the present invention operates substantially within the envelope of the side wall of the connector thus permitting connectors 120 to be spaced adjacent one another without having to allow additional spacing for a latch on the side or requiring additional real estate on the circuit board for end latches. Alternatively the connectors 120 may be inserted into respective outer shells 150, such as shown in FIG. 1, and used, for example, in a card cage or the like.

It is thought that the latching system of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. A system for latching first and second connectors together along a mating axis, the first and second connectors including first and second housings having opposed ends and sides, a pair of latch arms spaced a selected distance apart along a common side of the first housing and extending to free ends proximate a mating face, said latch arms being adapted to cooperate with respective complementary latching surfaces positioned along a corresponding common side surface of the second housing, the system being characterized in that:

respective free ends of said latch arms include latching projections extending toward said ends of said housing and defining rearwardly facing latching surfaces;

said common side surface of said second housing includes a pair of embossments having beams extending laterally outwardly from the second housing a second selected distance beyond a mating face to free ends, said embossments defining said complementary latch surfaces, said embossments being positioned in alignment with said free ends of said latch arms to be initially abutted by camming surfaces of said free ends during initial stages of latching; and said latch arms are adapted to be deflected toward said ends of said housing upon said camming surfaces bearing against said embossments, whereafter the latching projections pass by the embossments and become latched therebehind;

whereby upon mating of said connectors, said free ends of said beams extend along and outwardly of surface portions of said common side of the second housing to stabilize axial alignment and orientation of said connectors relative to each other during final stages of mating, said beams freely passing beside said latch arms during initial stages of mating until said connectors are axially aligned whereupon said latch arms latch during final stages of mating, said latch arms being deflectable in a direction parallel to said common side of the first housing minimizing the clearance area adjacent the housing needed for deflection of the latch arms.

2. The system for latching of claim 1 wherein said latch projections face toward each other and said latch arms deflect away from each other.

3. The system for latching of claim 1 wherein said latch arms are disposed in recesses on said common side surface such that overall dimensions of the connector housing are not substantially increased by said latch arms.

4. The system for latching of claim 1 wherein said camming surfaces of said latch arms engage respective shoulders of said embossments with sufficient resistance such that no further mating can occur until the application of increased axial mating force to overcome the resistance whereupon said latching arms are deflected around said shoulders and latch behind said embossments to rapidly complete the mating of said connectors.

5. The system for latching of claim 1 wherein upon completion of mating said latch arms engage rear surfaces of said embossments with sufficient resistance such that no unmating can occur until the application of sufficient pulling force to overcome the resistance whereupon said latching arms are rapidly deflected around said embossments and said connectors are rapidly unmated thus minimizing damage to terminals of said connectors, even when said connectors remain energized.

6. The system for latching of claim 1 wherein said embossments are essentially L-shaped.

7. The system for latching of claim 1 wherein said first housing further includes an anti-overstress embossment proximate said free end of each said latch arm and spaced from a side thereof opposed from said latch projections.

* * * * *